US009394665B2

(12) United States Patent
Wellens

(10) Patent No.: US 9,394,665 B2
(45) Date of Patent: Jul. 19, 2016

(54) APPARATUS FOR SECURING AND ALIGNING AN ATTACHED POST IN A PILE AND A CORRESPONDING METHOD

(71) Applicant: Trojan Services Limited, Greater Manchester (GB)

(72) Inventor: Stewart Wellens, Greater Manchester (GB)

(73) Assignee: TROJAN SERVICES LIMITED, Greater Manchester (GB)

( * ) Notice: Subject to any disclaimer, the term of this patent is extended or adjusted under 35 U.S.C. 154(b) by 23 days.

(21) Appl. No.: 14/378,704

(22) PCT Filed: Feb. 14, 2013

(86) PCT No.: PCT/GB2013/050345
§ 371 (c)(1),
(2) Date: Aug. 14, 2014

(87) PCT Pub. No.: WO2013/121199
PCT Pub. Date: Aug. 22, 2013

(65) Prior Publication Data

US 2016/0017564 A1 Jan. 21, 2016

(30) Foreign Application Priority Data

Feb. 16, 2012 (GB) ..... 1202680.3

(51) Int. Cl.
*E04H 12/22* (2006.01)
*E02D 27/42* (2006.01)
(Continued)

(52) U.S. Cl.
CPC *E02D 13/04* (2013.01); *E02D 5/03* (2013.01); *E02D 5/226* (2013.01); *E02D 5/54* (2013.01);
(Continued)

(58) Field of Classification Search
CPC ..... E02D 27/42; E04H 12/22; E04H 12/2238; E04H 12/2253; E04H 12/2269; E04H 12/2284
See application file for complete search history.

(56) References Cited

U.S. PATENT DOCUMENTS 716,968 A * 12/1902 Warner ..... E04H 12/2269 52/298
2,200,524 A * 5/1940 Watt ..... E02D 5/48 405/250

(Continued)

FOREIGN PATENT DOCUMENTS

DE 1926051 A1 12/1969
DE 2632314 A1 1/1978

(Continued)

OTHER PUBLICATIONS

Patent Cooperation Treaty, The International Search Report and the Written Opinion of the International Searching Authority, or the Declaration for PCT/GB2013/050345 mailed on Feb. 6, 2014, 10 pages.

(Continued)

*Primary Examiner* — Frederick L Lagman
(74) *Attorney, Agent, or Firm* — Hoffman Warnick LLC

(57) ABSTRACT

Improvements in and relating to installing posts Disclosed is an apparatus for securing and aligning an attached post in a pile, the apparatus comprising: a top plate for attaching to an upper surface of the pile, the top plate having an aperture through which passes the post; a plurality of adjusters, each connected to a first end of a linkage rod, which is connected at its opposite end to an associated pile engaging member, such that operation of each adjuster causes the associated pile engaging member to engage with an interior wall of the pile.

10 Claims, 3 Drawing Sheets

(51) Int. Cl.

| | |
|---|---|
| ***E02D 13/04*** | (2006.01) |
| ***E04H 12/32*** | (2006.01) |
| ***E02D 5/03*** | (2006.01) |
| ***E02D 5/22*** | (2006.01) |
| ***E02D 5/54*** | (2006.01) |
| ***E02D 5/60*** | (2006.01) |
| ***E02D 7/02*** | (2006.01) |

(52) U.S. Cl.
CPC .. *E02D 5/60* (2013.01); *E02D 7/02* (2013.01); *E02D 27/42* (2013.01); *E04H 12/22* (2013.01); *E04H 12/2253* (2013.01); *E04H 12/2284* (2013.01); *E04H 12/32* (2013.01)

(56) References Cited

U.S. PATENT DOCUMENTS

| | | | | |
|---|---|---|---|---|
| 3,514,911 | A * | 6/1970 | Preradovich | E04H 12/2261 52/165 |
| 3,579,936 | A | 5/1971 | Mattias et al. | |
| 6,042,301 | A | 3/2000 | Sovran | |
| 2003/0121223 | A1 * | 7/2003 | Riker | E04H 12/2269 52/296 |

FOREIGN PATENT DOCUMENTS

| | | | | |
|---|---|---|---|---|
| DE | 3129661 | A1 * | 2/1983 | E04H 12/182 |
| DE | 102011116030 | A1 * | 4/2013 | E01F 9/0117 |
| GB | 2122236 | A | 1/1984 | |
| JP | 57155429 | A | 9/1982 | |
| WO | 9708410 | A1 | 3/1997 | |

OTHER PUBLICATIONS

Great Britain Patent Office, Search Report under Section 17(5) for GB1202680.3 dated Jun. 19, 2012, 3 pages.

* cited by examiner

APPARATUS FOR SECURING AND ALIGNING AN ATTACHED POST IN A PILE AND A CORRESPONDING METHOD

The present invention relates to improved devices and techniques for installing and erecting vertical posts, such as the type used to support overhead cables in, for instance, railway systems. However, the apparatus and techniques disclosed herein can be used in a variety of different situations including, but not limited to, street lighting, antennas, telegraph poles, flagpoles and other situations requiring a substantially vertical supporting member.

In electrified railway systems, there is a requirement to provide vertical support members to support the overhead cabling, which is used to provide electrical power to the locomotives. Often, there is a need to electrify existing track which has historically been used by diesel locomotives. This electrification work is costly, both in terms of the actual costs of the equipment and labour, but also in terms of what is known as 'possession', which refers to the time that use of the railway is restricted due to work being performed on it.

There is a desire to restrict the time taken for maintenance and other activities which reduce the time available for trains to run on the track.

Even in the case of newly-built track, there is a need to provide relatively quick, easy to install and reliable equipment, to speed up the overall commissioning process.

When overhead electrical cabling is provided, it is necessary to install overhead gantries and supports at intervals along the track. Typically, in the prior art, excavation of points along the track is required, so that a suitable post can be positioned in the hole created, using a crane, so that the post is held in position while the hole is back filled, usually with a concrete mix which, once solidified, holds the post securely in position.

This process is time-consuming and it can be difficult to ensure that the post is suitably vertical.

Embodiments of the present invention aim to address shortcomings in the prior art, whether mentioned herein or not.

According to the present invention there is provided an apparatus and method as set forth in the appended claims. Other features of the invention will be apparent from the dependent claims, and the description which follows.

For a better understanding of the invention, and to show how embodiments of the same may be carried into effect, reference will now be made, by way of example, to the accompanying diagrammatic drawings in which.

Embodiments of the present invention make use of a two stage process for installing vertical support posts, hereafter termed posts. The first stage involves driving a pile into the ground at the location selected for the post. This can be achieved using standard pile driving techniques, and can be performed at the trackside or from a suitable railway vehicle if possible.

The pile is driven to a depth suitable to support the post which is later inserted therein. In a typical railway installation, a post of height 5-6 meters is required and it is found that a pile driven to a depth of up to 16 meters, depending on geology and local conditions, is suitable. Different types of post may require different pile depths, and different ground characteristics may necessitate different pile depths or other properties.

Figure 1:
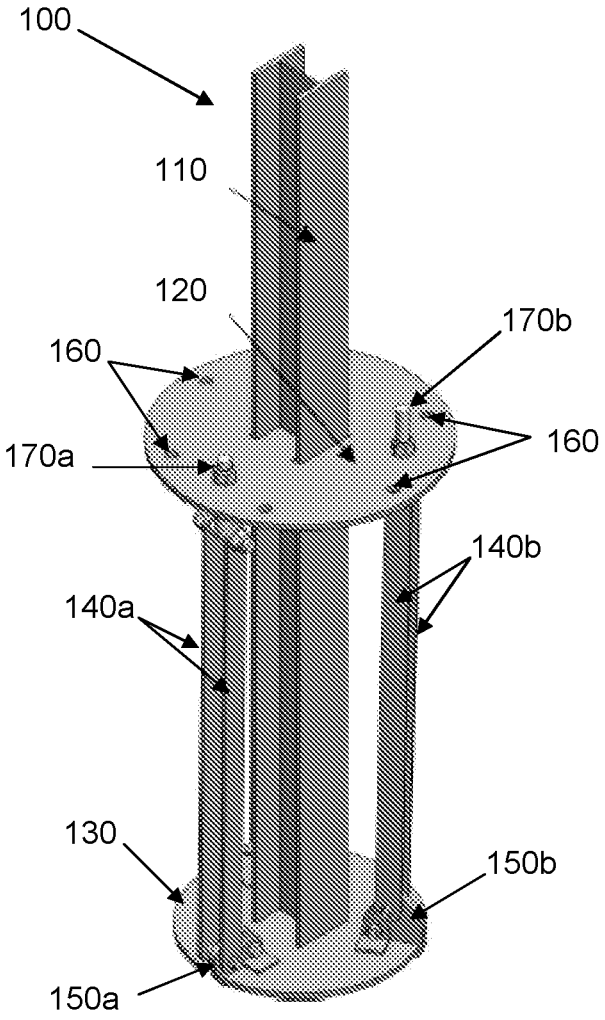
FIG. 1 shows a view of a post clamp according to an embodiment of the present invention.

FIG. 1 shows a clamp mechanism 100 according to an embodiment of the invention. The clamp mechanism is formed integrally with the end of the post 110. In other embodiments, the clamp mechanism may be formed separately and coupled to the post before installation.

The post 110 in this embodiment is in the form of an H-beam, but could be of any suitable profile, depending on the job it is to perform. The post is welded to lower end plate 130. In use, lower end plate 130 will sit at the bottom of the pile, which has been driven into the ground.

Pivotally mounted at a plurality of locations around the circumference of lower end plate 130 are pile-engaging members 150. In the embodiment shown, there are three such members (although only two are clearly visible in the figures—150*a* and 150*b*). These are located at 120° intervals around the circumference.

Figure 2:
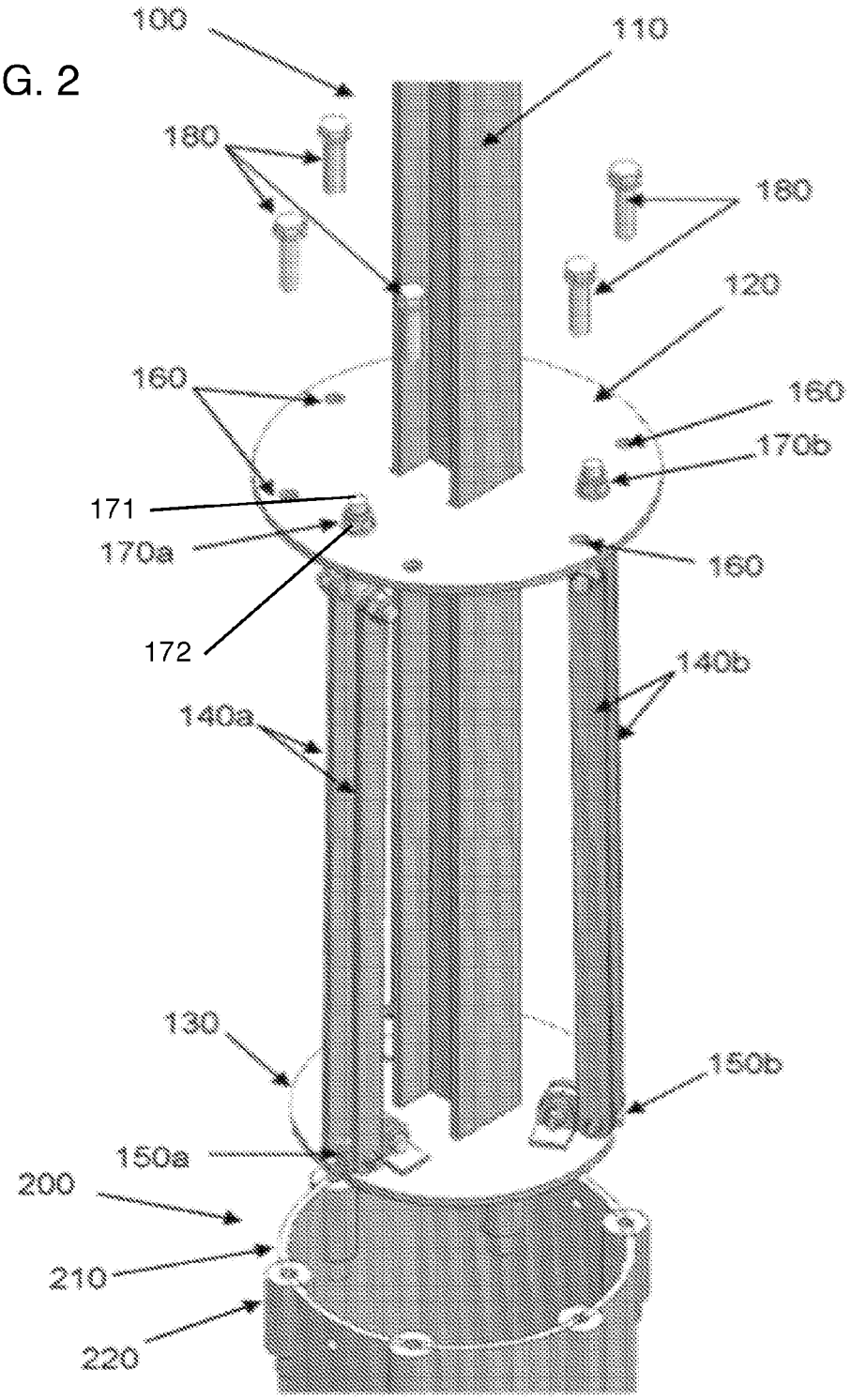
FIG. 2 shows a further view of a post clamp according to an embodiment of the present invention.

The pile engaging members 150 pivot under the action of linkage rods 140. The linkage rods are provided in pairs, such that a pair of linkage rods 140 are attached towards an upper end of the member 150 and extend upwardly towards adjusters 170. The adjusters 170 protrude through a top plate 120. In use, the top plate sits atop and is fastened to the exposed upper end of the pile 200 shown in FIG. 2.

The post and clamp assembly 100 is lowered into the interior of the pile 200 such that the top plate 120 rests on the upper surface of the pile. The pile, when driven, was located substantially vertically, but due to ground variations, it may deviate a little from being truly vertical. However, the clamp mechanism 100 is arranged to compensate for any such deviations as will now be described.

The lower end plate 130 is dimensioned to fit inside the pile, with a clearance provided so that it is not a particularly tight fit. The inner diameter of the pile is typically 578 mm, with a wall thickness of 16 mm, and the outer diameter of the lower end plate is arranged to sit inside this, with a gap of at least a few millimeters, to allow flexibility of movement as will be described.

The top plate 120 is dimensioned such that its outer diameter substantially matches the outer diameter of the pile 200. The post 100 passes through a suitable aperture in the top plate. The aperture is dimensioned so that the post 100 passes through it easily with some room for lateral movement. In the embodiment shown, the aperture in the top plate 150 is generally 'H' shaped to correspond to the profile of the post 110.

Once positioned inside the pile, the top plate 120 is secured into position using bolts 180, which pass through apertures 160 in top plate 120. The bolts 180 engage with threaded bosses 220, which are arranged around the circumference of pile 200 in positions corresponding to the locations of apertures 160.

In this configuration, there will be a degree of unsteadiness and lateral movement of the post 100, since it is not yet clamped into position. In order to properly secure it and to ensure it is sufficiently vertical, the pile engaging member 150 must be positioned to firmly clamp the post into the correct position.

To adjust the position of the pile engaging members 150, the adjusters 170 are used. The adjusters comprise a threaded rod which is operatively connected to the linkage rods 140 and which further protrudes through the top plate 120. The threaded rod engages with a bolt. By turning the nut 172, the threaded rod 171 is effectively pulled upwards which exerts a turning moment on the pile engaging member 150.

Figure 3:
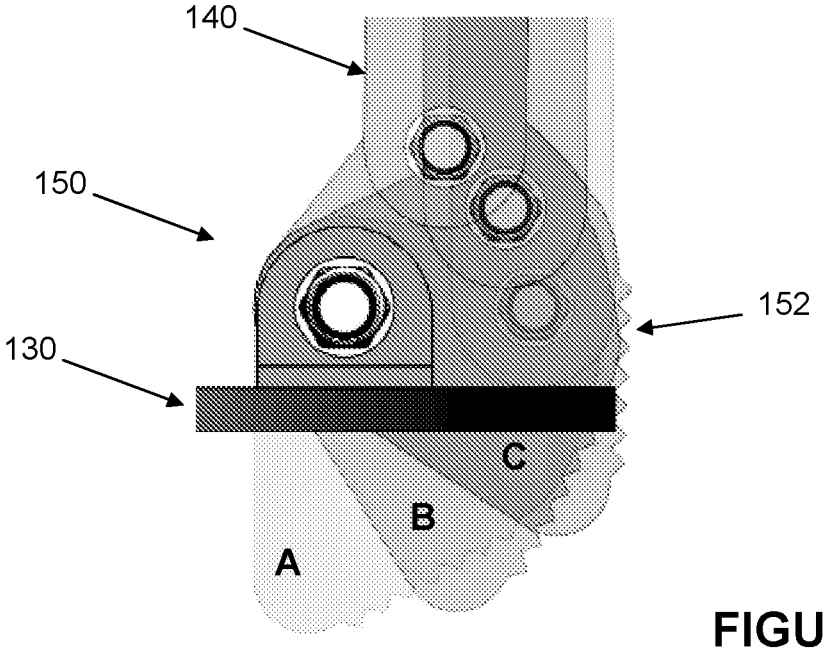
FIG. 3 shows a close up view of the clamping mechanism is different positions.

FIG. 3 shows a detailed view of the pile engaging member in three different positions, labelled A, B and C. Position A is the position of the pile-engaging member 150 when the clamp assembly 100 is first inserted into the pile 200. Bt adjusting the adjuster 170, the linkage rod 140 is forced upwards, which causes the pile engaging member to rotate and move towards a position where it extends beyond the edge of the lower end plate 130 and contact the interior of the wall 210 of the pile 200. The pile engaging member 150 is provided with a plurality of teeth 152 for improving the engagement with the wall 210 of the pile 200.

Figure 4:
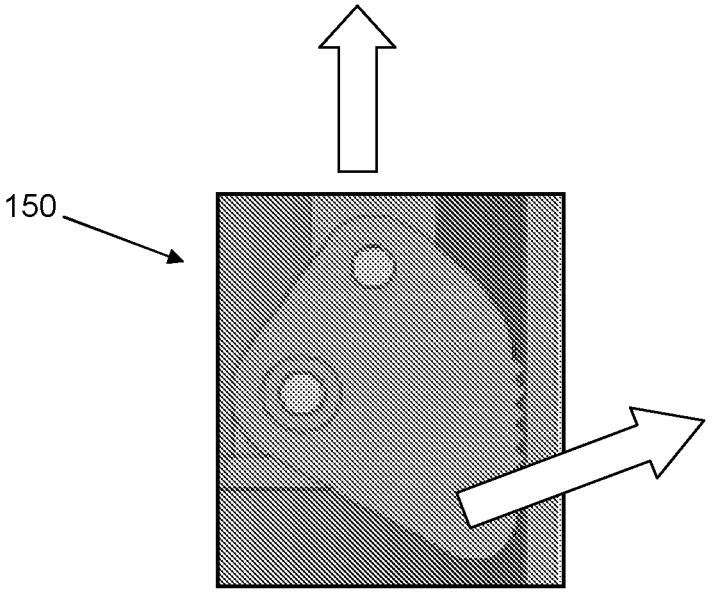
FIG. 4 shows a further illustration of the operation of the clamping mechanism.

FIG. 4 shows, in principle how increasing adjustment of the adjuster 170 causes the linkage rod 140 to move upwards and so exert a turning moment on pile-engaging member 150 so that the clamp assembly position within the interior of the pile can be altered.

By careful adjustment of the three adjusters 170, the post 100 can be re-positioned to be more substantially vertical. Increasing adjustment of a given adjuster will case the post to move in a corresponding direction. By providing a plurality of adjusters 170, the degree of fine tuning which is possible can be controlled. At least three adjusters are required.

The process by which the adjustment is performed may be iterative, in that each adjuster 170 may need to be adjusted more than once, preferably in a sequence, to ensure that the desired degree of adjustment is achieved.

Once the adjustment is complete, the nuts of the adjusters can be locked into position by the addition of a further locknut on the threaded bar.

The apparatus is constructed from steel of suitable dimensions to provide the necessary strength, in accordance with the size of the post to be supported. The various parts may be joined by welding if no relative movement is required, or by nuts and bolts if pivoting or rotation is required.

Attention is directed to all papers and documents which are filed concurrently with or previous to this specification in connection with this application and which are open to public inspection with this specification, and the contents of all such papers and documents are incorporated herein by reference.

All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any accompanying claims, abstract and drawings), or to any novel one, or any novel combination, of the steps of any method or process so disclosed.

The invention claimed is:

1. Apparatus for securing and aligning an attached post in a pile, the apparatus comprising:

a top plate for attaching to an upper surface of the pile, the top plate having an aperture through which passes the post; and a plurality of adjusters, each connected to a first end of a linkage rod, which is connected at its opposite end to an associated pile engaging member, such that operation of each adjuster causes the associated pile engaging member to engage with an interior wall of the pile, wherein each adjuster is connected to the associated pile engaging means by a pair of linkage rods.

2. The apparatus of claim 1 wherein the plurality of pile engaging members are disposed around the circumference of a lower end plate.

3. The apparatus of claim 2 wherein the post is welded to the lower end plate.

4. The apparatus of claim 1 wherein the plurality of adjusters protrude through the top plate.

5. The apparatus of claim 1 wherein the plurality of adjusters each comprise a threaded rod and a nut coupled thereto.

6. The apparatus of claim 1 wherein the pile engaging means comprises a plurality of teeth for engaging with an interior wall of the pile.

7. The apparatus of claim 1 wherein the top plate is provided with a plurality of apertures which align with corresponding bosses on the upper surface of the pile.

8. The apparatus of claim 1 further comprising the pile.

9. A method of securing and aligning a post in a pile, using an apparatus comprising:

a top plate for attaching to an upper surface of the pile, the top plate having an aperture through which passes the post; and a plurality of adjusters, each connected to a first end of a linkage rod, which is connected at its opposite end to an associated pile engaging member, such that operation of each adjuster causes the associated pile engaging member to engage with an interior wall of the pile, wherein each adjuster is connected to the associated pile engaging means by a pair of linkage rods, the method comprising:

inserting the apparatus into the interior of the pile;

securing the top plate to the pile; and adjusting the plurality of adjusters until the post is substantially vertical.

10. The method of claim 9 comprising the further step of locking the adjusters.

* * * * *